United States Patent [19]

Washington

[11] Patent Number: 5,069,458

[45] Date of Patent: Dec. 3, 1991

[54] ILLUMINATING PEG BOARD GAME

[76] Inventor: Nathaniel Washington, 10022 Kirkwren, Houston, Tex. 77089

[21] Appl. No.: 594,644

[22] Filed: Oct. 9, 1990

[51] Int. Cl.[5] ..... A63F 3/00

[52] U.S. Cl. ..... 273/238; 273/288; 273/287

[58] Field of Search ..... 273/238, 237, 264–268, 273/271, 288, 287, DIG. 24

[56] References Cited

U.S. PATENT DOCUMENTS

| | | | |
|---|---|---|---|
| 3,854,725 | 12/1974 | Cluck | 273/238 |
| 3,856,307 | 12/1974 | Tinman | 273/238 |
| 3,887,189 | 6/1975 | Dawes | 273/238 |
| 4,616,832 | 10/1986 | Groner | 273/238 |

FOREIGN PATENT DOCUMENTS

| | | | |
|---|---|---|---|
| 883420 | 7/1953 | Fed. Rep. of Germany | 273/238 |

*Primary Examiner*—Benjamin Layno
*Attorney, Agent, or Firm*—Kenneth D. Baugh

[57] ABSTRACT

An illuminating peg board game 20 is provided including peg 58 and 60 having numerically identified electrical sockets 64 formed therein. Each socket 64 is provided to activate a light illuminating peg 66 when placed in the socket. Some of the pegs illuminate a constant light when activated while the other pegs illuminate a blinking light when activated. The game is played with two players. In playing the game each player is provided with a pair of dice 100 which is used to identify which particular socket or sockets will have a light illuminating peg inserted therein. The object is for a player to completely fill the sockets 64 in one or the other of the boards 58 or 60 with illuminating pegs 66 before the opponent can fill the sockets 64 in the other board. The first to completely fill the assigned board 58 or 60 wins the game.

13 Claims, 3 Drawing Sheets

ILLUMINATING PEG BOARD GAME

TECHNICAL FIELD

This invention relates to a board game, and more particularly a board game including two opposing contestants that attempting to fill opposing boards with illuminating pegs.

In an ever growing technically oriented society even games utilized for their entertainment value must be intellectually challenging. Thus games of skill and strategy have become very popular forms of entertainment. Board games have been particularly popular in this regard. However some of the more popular board games, such as, for example chess although intellectually stimulating can become somewhat predictable.

In an effort to overcome predictability often board games are combined with electronics thus more often than not they are made to be more complex often to the point of being too complex for entertainment purposes.

What is needed then is a board game which although intellectually challenging is not so undesirably complexed that its entertainment value is lost. One approach to providing an intellectually stimulating game while utilizing the advantages of electronic technology is providing a game which also employs the element of chance.

BACKGROUND ART

A number of attempts have been made to provide board games to satisfy our ever growing need for entertainment while still finding intellectual stimulation.

One such game is illustrated in U.S. Pat. No. 3,568,357 which discloses a game apparatus for forming pictures or playing games by means of illuminated pegs or molded objects inserted in holes of a peg board.

Another board game is disclosed in U.S. Pat. No. 3,404,889 which discloses an electrical game apparatus having multiple circuit ports to be selectively completed and interrupted by opposing players.

Although board games such as these may be enjoyable they can very well range from not intellectually challenging enough to too complex for entertainment value.

DISCLOSURE OF THE INVENTION

An illuminating peg board game apparatus in accordance with the principles of this invention includes a support member. A first board member having a plurality of spaced aligned apertures formed therein is coupled to the support member. A first plurality of identifiable electrical sockets is provided. Each one of the first plurality of sockets is aligned in a corresponding one of the spaced aligned apertures in the first board member. A second board member having a plurality of spaced aligned apertures formed therein is coupled to the support member in spaced alignment with the first board member. The second board member is also provided with a plurality of identifiable electrical sockets each one of which is aligned in a corresponding one of the plurality of spaced apertures formed therein. A plurality of light illumination members are provided for insertion into anyone of the plurality of sockets. The board game apparatus also includes a means coupled to the first and second plurality of sockets for energizing the sockets so that upon insertion of an illuminating member into anyone of the plurality of sockets the illuminating member is activated.

BRIEF DESCRIPTION OF THE DRAWING

The details of the invention will be described in connection with the accompanying drawing in which.

DESCRIPTION OF THE PREFERRED EMBODIMENT

Figure 1:
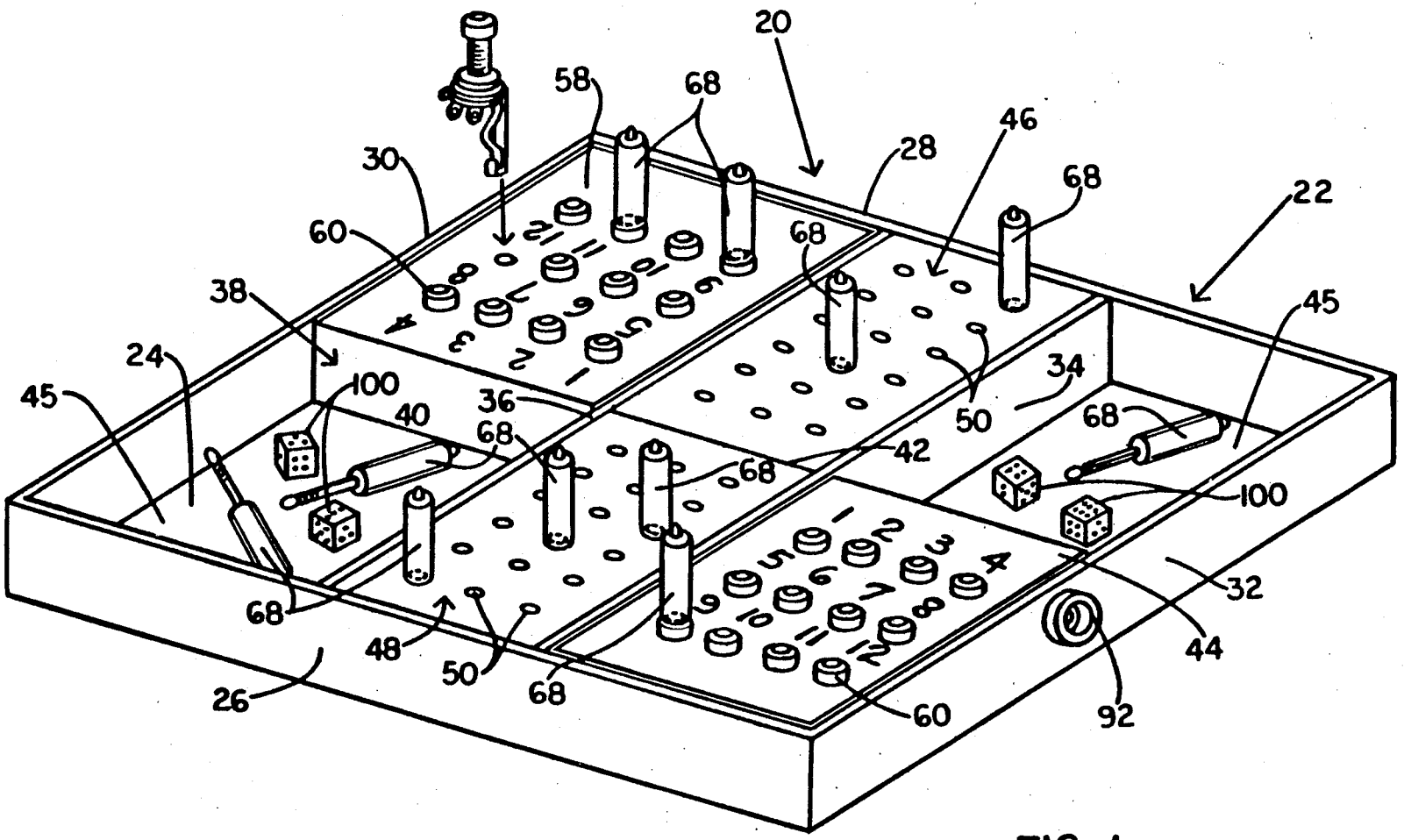
FIG. 1 is a perspective view of an Illuminating Peg Board game in accordance with principles of the invention.

Referring to FIG. 1 there is shown an illuminating peg board game, generally designated, by the numeral, 20. The illuminating peg board game 20 is provided with a rectangularly shaped support housing or playing board, generally designated, by the numeral, 22. The playing board 22 includes a base member 24 aligned side walls 26 and 28 and end walls 30 and 32.

A pair of spaced laterally extending partitions 34 and 36 are coupled to extend between the side walls 26 and 28 in parallel alignment with the end walls 30 and 32. An intermediate wall support, generally designated, by numeral 38, having wall partitions 40, 42 and 44, is coupled between end walls 30 and 32 in parallel alignment with side walls 28 and 26.

The laterally extending partitions 34 and 36 and intermediate wall support 38 cooperates with the base member 24 side wall 26 and 28 and end walls 30 and 32 to form storage compartments 45 and support peg boards, generally designated, by the numerals, 46, 48, 58 and 60.

Figure 3:
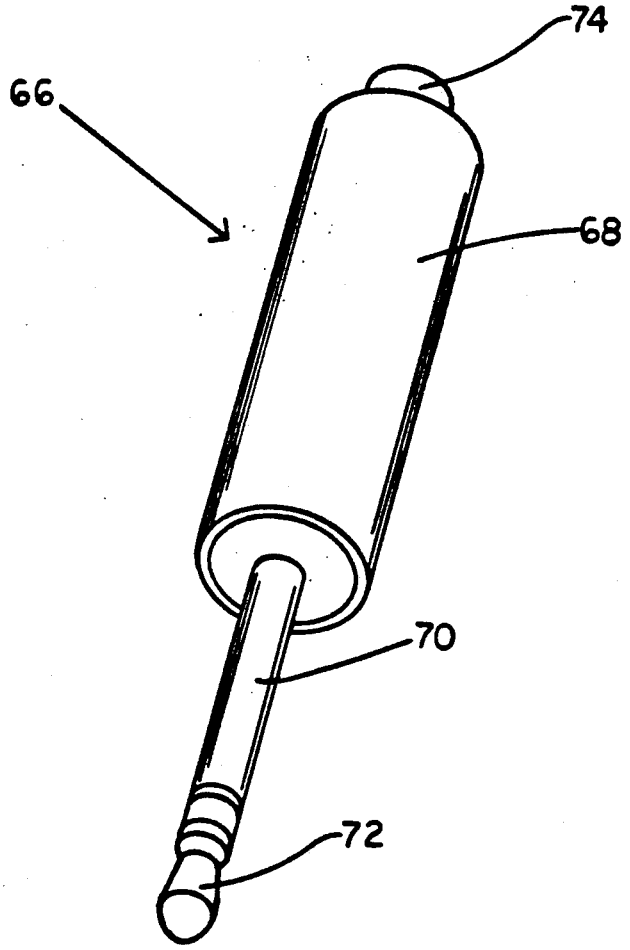
FIG. 3 is a perspective view of an illuminating peg of the Illuminating Peg Board game in accordance with the principles of the invention.

The peg boards, 58 and 60 are provided with spaced aligned apertures 62 formed therein. Each aperture 62 in peg boards 58 and 60 is provided with an electrical socket 64. The sockets 64 on each board 58 and 60 is identifiable, such as, for example, by numeric designation from one (1) through twelve (12). Each socket 64 is provided to activate a light illuminating device or peg 66 (FIG. 3) when placed in the socket. Each of the pegs 66 is provided with a support member 68 having an elongated electrical connector 70 extending therethrough. One end 72 of the connector 70 is provided to be electrically coupled into the socket and the other end thereof and is electrically coupled to a light or bulb 74. The peg 66 may be any well known light emitting device, such as, for example, a light emitting diode (LED). In accordance with the principles of the invention some of the pegs 66 will illuminate a constant light when activated and others will illuminate a blinking light when activated.

Figure 2:
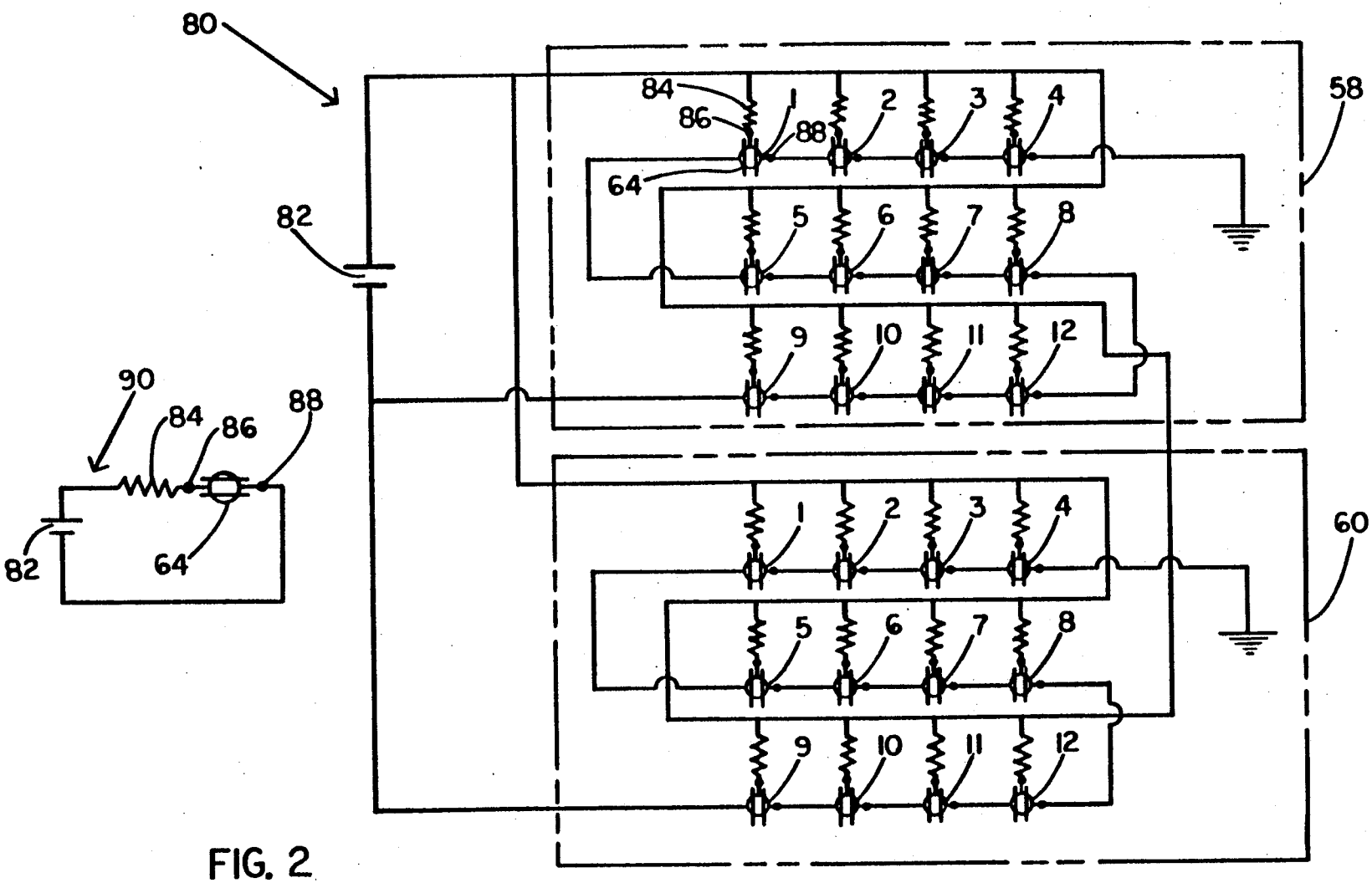
FIG. 2 is a circuit diagram used in the Iluminating Peg Board game in accordance with the principles of this invention.

Referring to FIG. 2 electrical power to energize the sockets 64 of the boards 58 and 60 is provided by a circuit, generally designated, by the numeral, 80.

The circuit 80 is provided with a low voltage DC source 82. The voltage source 82 is coupled to a plurality of resistors 84. Each one of the resistors 84 is coupled from the source 82 to a terminal 86 of one of the sockets 64. Another terminal 88 of the socket 64 is coupled to ground to complete the circuit. As a result a DC circuit 90 including the voltage source 82 a resistor 84 and the socket 64 is provided to energize each socket and provide power to activate the illuminating peg 66 when inserted in the socket. The DC voltage source 82 can be provided to the support housing 22 at an electrical connector 92 in a well known manner.

Peg boards 46 and 48 are provided with spaced aligned apertures 50 formed therein. The peg boards 46 and 48 are coupled to the support housing 22 adjacent the boards 58 and 60. Peg boards 46 and 48 are provided to retain selected ones of the pegs 66 which are not being used on the boards 58 and 60 while the game is being played.

The Illuminating Peg board game 20 requires twelve illuminating pegs 66 which emit a constant light for each of the boards 58 and 60. Additionallly six illuminating pegs which emit a flashing or blinking light, which are referred to as spoilers, is provided for each board 58 ad 60. Eight illuminating pegs which illuminate a different color light than the other pegs, known as protectors, is also required. In addition to the illuminating peg board game 20 also includes two sets of dice 100.

The game is played by two players. In playing the game the object is for each player to completely fill the side of the board 58 or 60 assigned to that player before the opponent's board is filled.

Initially each player is allowed to place a peg 66 known as the protector in two of the numerically designated sockets. Each player will then roll one dice of the set 100 to determine who plays first. Each player rolls the dice during the playing of the game in the storage compartment 45 directly in front of the opponent's board. When the game is begun all of the pegs 68 are removed from the storage compartment 45 so that the dice can be rolled without interference from the pegs. The player who rolls the highest number will start the game. The first play will be made using the two numbers rolled by the players to determine who would play first. This play, as well, as all other plays can be a combination of the two numbers rolled or each number can be used seperately. Thus if the player using board 58 had the highest number and the numbers rolled were 5 and 6 the numbers can be combined so that a constant illuminated peg 66 can be inserted in the socket that is designated socket 11 (FIG. 1) or the numbers can be used seperately so that a constant illuminating peg can be inserted in two sockets, that is, the socket designated socket 5 and the socket designated socket 6 (FIG. 1). Thereafter each player will alternately roll his pair of dice to get two numbers which can be combined or used seperately to fill the sockets on that player's side of the board.

Additionally if the right numbers are rolled players can capture each others sockets by filling a socket already occupied by the opponent on the opponent's side of the board. For example, if the player using board 58 rolls the pair of dice 100 and rolls the numbers 5 and 4 this player can decide to capture position 9 on the board 60. If this is done the constant illuminating peg 66 in socket 9 (FIG. 1) is removed and placed in storage section 46 adjacent the board 58 and a flashing illuminating peg, that is, a spoiler, is placed in this position indicating the position has been captured by the opponent.

As a result the player on board 60 that is the captured player cannot capture any of the opponent's sockets or spaces, or continue to fill the board 60 until the captured socket is regained by the captured player rolling a 9 again. The process of capturing sockets can be accomplished up until a maximum of four sockets are captured. That is no player can capture more than four of the opponent's sockets at any one time during the game.

As initially noted the protectors can be used by each player on any two spaces of choice with the exception of space number 12. These protected spaces cannot be captured by the opponent.

Additionally any player who rolls two double six's with the dice 100 in any one game can demand the opponent clear the opponent's side of the board thus making that person start all over. However double six's cannot be used to clear the opponent's board if the player rolling the double six's is in the captured position. Still further the game provides that any player who rolls three double six's in a game automatically wins the game.

The invention has been shown and described in what is considered to be the most practical and preferred embodiment. However, it should be recognized that changes may be made by those skilled in the art without departing from the spirit and scope of the invention.

I claim:

1. An illuminating peg game board apparatus including:

a support member;

a first board member having a plurality of spaced aligned apertures formed therin, coupled to the support member;

a first plurality of identifiable electrical sockets one of the plurality of sockets being aligned in a corresponding one of the spaced aligned apertures in the first board member;

a second board member, having a plurality of spaced aligned apertures formed therein, coupled to the support member in spaced alignment with the first board member;

a second plurality of identifiable electrical sockets one of the second plurality of sockets being aligned in a corresponding one of the spaced aligned apertures in the second board member;

a plurality of light illuminating members for insertion into anyone of the plurality of sockets;

means coupled to the first and second plurality of sockets for energizing the sockets so that upon insertion of a light illuminating member into anyone of the plurality of sockets the light illuminating member is activated; and means for determining which one of the plurality of sockets will have a light illuminating member inserted therein.

2. An illuminating peg game board apparatus as defined in claim 1 further including a third board member having apertures formed therein, coupled to the support member adjacent the first board member for storing predetermined ones of the plurality of light illuminating members thereon prior to insertion into the first board member.

3. An illuminating peg game board apparatus as defined in claim 2 further including a fourth board member, having apertures formed therein, coupled to the support member adjacent to the second board member for storing predetermined ones of the plurality of light illuminating members thereon prior to insertion into the second board.

4. An illuminating peg game board apparatus as defined in claim 3 wherein the support member includes a first compartment adjacent the first board member for storing predetermined ones of the plurality of light illuminating members therein after removal from the first board.

5. An illuminating peg game board apparatus as defined in claim 4 wherein the support member includes a second compartment adjacent the first board member for storing predetermined ones of the plurality of light illuminating members thereon after removal from the second board.

6. An illuminating peg game board apparatus as defined in claim 5 wherein the plurality of light illuminating members includes:

a first plurality of light illuminating members, each one of the illuminating members illuminating a constant light, for insertion into the first board member at predeterminable intervals;

a second plurality of light illuminating members, each one of the illuminating members illuminating a constant light, for insertion into the second board member at predeterminable intervals;

a third plurality of light illuminating members, each one of the illuminating members illuminating a flashing light, for insertion into the first board upon removal of one of the first plurality of light illuminating members therefrom; and a fourth plurality of light illuminating members, each one of the illuminating members illuminating a flashing light, for insertion into the second board upon removal of one of the second plurality of light illuminating members therefrom.

7. An illuminating game board apparatus as defined in claim 6 wherein the plurality of light illuminating members further includes a fifth plurality of light illuminating members, each one of the illuminating members illuminating a constant light distinct from the first and second plurality of light illuminating members, for insertion into predetermined sockets on the first and second boards.

8. An illuminating peg game board apparatus as defined in claim 7 wherein the determining means includes a pair of dice.

9. An illuminating peg game board apparatus as defined in claim 8 wherein each of the plurality of light illuminating members is a light emmitting diode.

10. An illuminating peg game board apparatus including:

a support member;

a first board member, having a plurality of spaced aligned identifiable electrical sockets formed thereon, coupled to the support member;

a second board member, having a plurality of spaced aligned identifiable electrical sockets formed thereon, coupled to the support member in diagonally spaced alignment with the first board member;

means for energizing the sockets on the first and second board members;

a first plurality of light illuminating members each one of the light illuminating members for insertion into determinable ones of the sockets on the first board member;

a second plurality of light illuminating members, each one of the illuminating members for insertion into determinable ones of the sockets on the second board member;

a first plurality of flashing light illuminating members each one of the flashing light illuminating members for insertion into predeterminable ones of the sockets on the second board member upon removal of predetermined ones of the second plurality of light illuminating members from the second board;

a second plurality of flashing light illuminating members each one of the flashing light illuminating members for insertion into predeterminable ones of the sockets on the first board member upon removal of predetermined ones of the first plurality of light illuminating members from the first board; and a third plurality of light illuminating members each one for insertion into predetermined ones of the sockets on the first and second board members before any other illuminating members are inserted on the first and second board members.

11. An illuminating peg game board apparatus as defined in claim 10 further including means for determining which socket of the first and second board members will receive a light illuminating member.

12. An illuminating peg game board apparatus as defined in claim 11 wherein the determining means includes a pair of dice.

13. An illuminating peg game board apparatus as defined in claim 11 where each one of the light illuminating members is a light emitting diode.

* * * * *